US009759026B2

(12) United States Patent
Liu et al.

(10) Patent No.: US 9,759,026 B2
(45) Date of Patent: Sep. 12, 2017

(54) WELLBORE PRESSURE CORRECTION METHOD

(71) Applicant: Drilling Research Institute of China National Petroleum Company, Beijing (CN)

(72) Inventors: Wei Liu, Beijing (CN); Lin Shi, Beijing (CN); Kai Wang, Beijing (CN); Yingcao Zhou, Beijing (CN); Xiaoqiang Zhai, Beijing (CN); Qingfeng Guo, Beijing (CN); Boqi Zhou, Beijing (CN)

(73) Assignee: Drilling Research Institute of China National Petroleum Company, Beijing (CN)

( * ) Notice: Subject to any disclaimer, the term of this patent is extended or adjusted under 35 U.S.C. 154(b) by 0 days.

(21) Appl. No.: 15/418,283

(22) Filed: Jan. 27, 2017

(65) Prior Publication Data

US 2017/0138137 A1 May 18, 2017

Related U.S. Application Data

(63) Continuation of application No. PCT/CN2015/085518, filed on Jul. 30, 2015.

(30) Foreign Application Priority Data

Jul. 30, 2014 (CN) ..... 2014 1 0370007

(51) Int. Cl.
*E21B 21/08* (2006.01)
*E21B 21/10* (2006.01)
(Continued)

(52) U.S. Cl.
CPC ..... *E21B 21/08* (2013.01); *E21B 21/106* (2013.01); *E21B 34/02* (2013.01); *E21B 47/06* (2013.01)

(58) Field of Classification Search
CPC ..... E21B 21/08; E21B 21/106; E21B 21/10; E21B 34/02; E21B 47/06; E21B 47/00; E21B 44/00; E21B 7/00
See application file for complete search history.

(56) References Cited

U.S. PATENT DOCUMENTS 8,240,398 B2 * 8/2012 Lovorn ..... E21B 21/08 175/38
2009/0139767 A1 6/2009 Jeffryes
2013/0133948 A1 * 5/2013 Lovorn ..... E21B 21/08 175/24

FOREIGN PATENT DOCUMENTS

CN 102454372 A 5/2012
CN 102943620 B 8/2013
(Continued)

OTHER PUBLICATIONS

International Search Report and Written Opinion from PCT/CN/2015/085518 dated Oct. 10, 2015.
(Continued)

*Primary Examiner* — Wei Wang
(74) *Attorney, Agent, or Firm* — Calfee Halter & Griswold LLP

(57) ABSTRACT

This invention discloses a method for wellbore pressure correction. The method comprises: measuring a bottom hole pressure using a downhole pressure measurement-while-drilling tool; calculating a predicted bottom hole pressure; and correcting a wellbore pressure using the measured bottom hole pressure and the predicted bottom hole pressure, to achieve managed pressure drilling (MPD). The invention makes up for the defect in the existing art that the difference between a wellbore pressure calculation processing method and the actual downhole pressure is relatively great, and is capable of more quickly and accurately calculating the wellbore pressure in real time so that accurate
(Continued)

calculation and real-time correction and control of dynamic wellbore pressure on a narrow density window formation are achieved, thereby meeting the requirement of good bottom hole pressure and the requirement of ensuring safe and quick drilling.

6 Claims, 1 Drawing Sheet

(51) Int. Cl.
*E21B 34/02* (2006.01)
*E21B 47/06* (2012.01)

(56) References Cited

FOREIGN PATENT DOCUMENTS

| | | | | | |
|---|---|---|---|---|---|
| CN | 102402184 | | | 11/2013 | |
| CN | 104213906 | A | | 12/2014 | |
| CN | 104213906 | B | * | 8/2015 | ..... E21B 47/06 |
| WO | 0223011 | A1 | | 3/2002 | |

OTHER PUBLICATIONS

International Preliminary Report on Patentability from PCT/CN/2015/085518 dated Jan. 31, 2017.

* cited by examiner

WELLBORE PRESSURE CORRECTION METHOD

CROSS-REFERENCE TO RELATED APPLICATIONS

This application is a continuation of PCT Application No. PCT/CN2015/085518 filed on Jul. 30, 2015, which claims priority to Chinese Application No. 201410370007.2 filed on Jul. 30, 2014, the contents of which are hereby incorporated by reference as if recited in their entirety.

FIELD OF THE INVENTION

The invention relates to the field of petroleum drilling engineering, and in particular, to a wellbore pressure correction method.

BACKGROUND OF THE INVENTION

During a drilling process of petroleum and natural gas, calculation and control for the wellbore pressure become very important in order to avoid complicated accidents such as leakage, kick, hole instability, sticking, and/or the like. Currently, a gas-liquid two-phase flow theory is one of theoretical bases of gas-liquid two-phase flow simulated calculation for the wellbore, which establishes a gas-liquid two-phase continuity equation, a momentum equation by dividing different flow patterns, to simulate a flow state. However, differences between different calculation methods are relatively large and thus the precision is hard to meet requirements for calculation of dynamic pressure of a delicate controlled pressure wellbore for pressure sensitive formation.

To avoid the occurrence of the accidents, the drilling method for managed pressure drilling (MPD) has been widely used in the field of drilling petroleum and natural gas. However, there is no solution for a real-time control of the MPD pressure yet to satisfy the requirements for fast and accurate calculation of the dynamic pressure of the wellbore for petroleum and natural gas.

SUMMARY OF THE INVENTION

An object of the invention is to provide a wellbore pressure correction method to more fastly and accurately calculate the pressure of wellbore in real-time.

To achieve the abovementioned purpose, an embodiment of the invention provides a method for wellbore pressure correction, comprising: measuring a bottom hole pressure using a downhole pressure measurement-while-drilling tool; calculating a predicted bottom hole pressure; and correcting a wellbore pressure using the measured bottom hole pressure and the predicted bottom hole pressure to achieve MPD.

Preferably, the predicted bottom hole pressure is calculated according to the following equation: $P_b(t)=P_h(t)+P_f(t)+P_w(t)$, where $P_b(t)$ is the bottom hole pressure at time t, $P_h(t)$ is a hydrostatic column pressure at time t, $P_f(t)$ is an annular pressure lost at time t, and $P_w(t)$ is a wellhead back pressure at time t.

Preferably, $P_h(t)=\rho_{mix}(t)gH(t)$, where $$\rho_{mix}(t) = \frac{m_g(t) + m_l(t)}{V(t)},$$

$m_g(t)$ is an annular gas mass for the wellbore at time t, $m_l(t)$ is an annulus liquid mass at time t, V(t) is a volume of annular at time t, g is a gravitational acceleration, and H(t) is an actual depth-drilled at time t.

Preferably, $$P_f(t) = f\frac{\rho_{mix}(t)H(t)v_{mix}^2(t)}{2D_a},$$

where $$v_{mix}(t) = \frac{Q_{mix}(t)}{A},$$

$$Q_{mix}(t)$$

is a measured value by a mass flowmeter at time t, A is an annular flow area, $D_a$ is a hydraulic diameter, and f is a coefficient of friction resistance.

Preferably, $P_w(t)=P_{w0}-\Delta P_h(t)+\Delta P_{safe}$ where $\Delta P_{safe}$ is an additional safety pressure value, $P_{w0}$ is the wellhead back pressure in the absence of overflow, $$\Delta P_h(t) = -\frac{(\rho_i - \rho_g)V_g t}{V}gH,$$

$\rho_t$ is an annulus liquid density, $\rho_g$ is a gas density on the condition of an average pressure being $[(P_b-P_w)/2, (P_b+P_w)/2]$, V is a volume of annular in the presence of overflow, H is a well depth in the presence of overflow, $V_g(t)=\int_0^t q_g(t)\,dt$, $q_g(t)$ is an overflow velocity at time t, $P_b$ is a bottom hole pressure preset at the time of designing the MPD, $P_w$ is a pressure value in a safe range of the wellhead back pressure for the MPD, H is a current well depth, V is the volume of annular corresponding to the current well depth.

Preferably, correcting the wellbore pressure using the measured bottom hole pressure and the predicted bottom hole pressure to achieve MPD comprises checking an annular pressure lost according to the following equation to achieve MPD:

$$P_f(t)_{new} = f'\frac{\rho_{mix}(t)H(t)v_{mix}^2(t)}{2D_a};$$

where $$f' = \frac{P'_f(t)}{P_f(t)}\cdot f,$$

$$P'_f(t) = P_f(t) - \Delta P(t),$$

$$\Delta P(t) = P_b(t) - P_{pwd}(t),$$

$$P_f(t)_{new}$$

is a checked annular pressure lost at time t, and $P_{pwd}(t)$ is the measured bottom hole pressure at time t.

Preferably, correcting the wellbore pressure using the measured bottom hole pressure and the predicted bottom hole pressure to achieve MPD comprises checking the wellhead back pressure according to the following equation to achieve MPD: $P'_w(t)=P'_b(t)-P_h(t)-P_f(t)$; where $P'_w(t)$ is a checked wellhead back pressure at time t, $$\alpha = \frac{P_{pwd}(t)}{P_b(t)},$$

$$P'_b(t) = \alpha P_b(t).$$

Preferably, the method further comprises controlling a choke valve aperture such that the annular pressure lost reaches the checked annular pressure lost or the wellhead back pressure reaches the checked wellhead back pressure.

One or more embodiments of the invention can overcome the defect existing in the prior art, that is, the difference between a downhole pressure calculated from a wellbore pressure calculation processing method and the actual downhole pressure is relatively large. One or more embodiments of the invention can also be able to more quickly and accurately calculate the wellbore pressure in real time to achieve accurate calculation and real-time correction and control of dynamic wellbore pressure on a narrow density window formation, and thereby achieve a good control of bottom hole pressure and guarantee safe and quick drilling.

Other features and advantages of the present invention will be illustrated further in detail while explaining embodiments hereafter.

BRIEF DESCRIPTION OF DRAWINGS

The accompanying drawings are provided here to facilitate further understanding of the present invention, and constitute a part of this specification, they are used in conjunction with the following embodiments to explain the present invention, but shall not be construed as constituting any limitation to the present invention, wherein.

DESCRIPTION OF THE SYMBOLS

10 Mud pump
12 Choke valve
14 Mass flowmeter

DETAILED DESCRIPTION OF THE EMBODIMENTS

Some embodiments of the present invention will be described in detail hereafter. It is appreciated that these embodiments are used to explain and illustrate the present invention, but by no means to limit the present invention.

In embodiments of the invention, the correction of the wellbore pressure may be based on the basic principles of the mass and pressure conservation and the wellbore gas-liquid two-phase flow theory.

Figure 1:
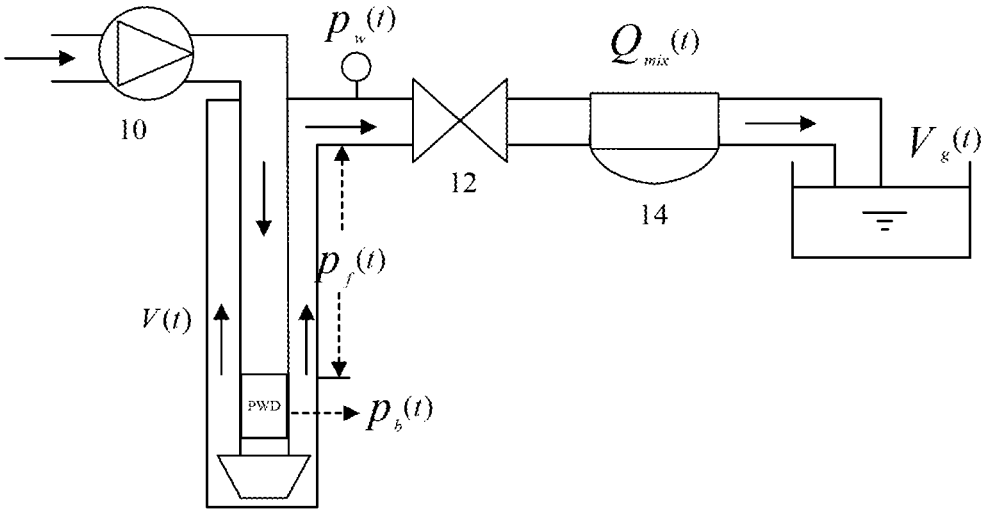
FIG. 1 is a schematic diagram of the wellbore pressure distribution.

FIG. 1 shows a schematic diagram of a distribution of wellbore pressure. As shown in FIG. 1, a mud pump 10 pumps drilling circulating liquid into a well; annular circulating liquid will enter into a mud tank through a choke valve 12 and a mass flowmeter 14. Considering the formation is of water or liquid breakthrough, the density of which differs little from that of the drilling circulating liquid, and thus a change in the wellbore pressure is relatively slow, thereby the MPD is relatively easy to be done. Therefore, only the situation where the formation is outgassed is considered rather than the situation of water or fluid-breakthrough, while calculating the wellbore pressure for the MPD.

During the process of correction of the wellbore pressure, different correction approaches can apply for different situations. Embodiments of the invention primarily employ two correction approaches: one is related to checking the annular pressure lost and the other is related to checking the wellhead back pressure. The following will describe in detail how to perform the wellbore pressure correction according to the basic principles of mass and pressure conversation.

According to the mass conversation law, in a case that there is a stable drilling liquid circulating system, with no fluid input and fluid output and no additional energy exchange, the mass is considered in balance. In a case that the mass is balanced, it necessarily means energy balance, i.e., pressure balance. In a case that the mass is unbalanced, energy will be unbalanced, so that the pressure will not be in balance. According to the energy conservation law, a total drilling liquid volume=a drilling tool water hole volume+a wellbore volume of annular+a mud tank volume=a constant. The drilling tool can be considered as remaining unchanged in a certain time period, so the drilling tool water hole volume remains relatively unchanged; therefore, it can be considered that: a wellbore volume of annular+a mud tank volume=a constant.

Without considering fluid's acceleration motion, according to the pressure conservation principle, the bottom hole pressure is given by:

$$P_b(t)=P_h(t)+P_f(t)+P_w(t) \tag{1}$$

In the equation:

$P_b(t)$: a bottom hole pressure at time t;

$P_h(T)$: a hydrostatic column pressure at time t;

$P_f(t)$: an annular pressure lost at time t;

$P_w(t)$: a wellhead back pressure at time t (i.e, an upstream pressure of a choke valve).

Notably, since the gas in the formation is injected into the bottom and returns upward along an annulus space, gas compressibility needs to be considered. A change in the hydrostatic column pressure is also due to the change in density of a mixture. $P_b(t)$ can be calculated and predicted using a model, $P_w(t)$ can be measured in real time by an apparatus such as a pressure sensor.

The hydrostatic column pressure and the annular pressure lost are calculated as follows:

$$P_h(t) = \rho_{mix}(t)gH(t) \tag{2}$$

$$\rho_{mix}(t) = \frac{m_g(t) + m_l(t)}{V(t)} \tag{3}$$

In the above equations, $\rho_{mix}(t)$ is the density of the mixing liquid within the wellbore at time t; H(t) is an actual depth-drilled at time t; $m_g(t)$ is an annular gas mass for the wellbore at time t; $m_l(t)$ is an annulus liquid mass at time t; V(t) is a volume of annular at time t, which can be calculated based on a wellbore structure and a diameter of an open hole section and a volume of a well-entering part of a drilling string.

$m_g(t)=\rho_g V_g$, where $\rho_g$ is the gas density if an average pressure is $[(P_b-P_w)/2, (P_b+P_w)/2]$. At this time, $P_b$ is a bottom hole pressure preset when designing the MPD, $P_w$ is required to be within a safe range of the wellhead back pressure for the MPD. For example, it is specified as [0, 5] MPa. $\rho_g$ can be considered as a constant.

$V_g(t)$ is a downhole overflow amount, which can be calculated according to the following equation:

$$V_g(t)=\int_0^t q_g(t)dt \tag{4}$$

$q_g(t)$ is an overflow velocity at time t, which can be obtained by measuring a liquid level of the mud tank.

$$m_l=\rho_l(V(t)-V_g(t)) \tag{5}$$

When special working conditions such as overflow or leakage occur, drilling will not continue and it is required the processing for the special working conditions is complete at the current depth before continuing drilling; at this time, V(t) and H(t) are respectively a volume of annular V and a well depth H corresponding to the current well depth, where $\rho_l$ is the density of the drilling liquid. The time t is derived by the equation (2):

$$\frac{dp_h(t)}{dt} = -\frac{(\rho_1 - \rho_g)q_g(t)}{V}gH \tag{6}$$

The annular pressure lost is calculated by the following equations:

$$\frac{1}{\sqrt{f}} \approx -1.8\ \log_{10}\left[\frac{6.9}{\mathrm{Re}} + \left(\frac{\epsilon/D_a}{3.7}\right)^{1.11}\right] \tag{7}$$

$$v_{mix}(t) = \frac{Q_{mix}(t)}{A} \tag{8}$$

$Q_{mix}$(t): a measured value by the mass flowmeter at time t (volume flow)

A: an annular flow area;

$D_a$: hydraulic diameter, $$D_a = \frac{D_o - D_i}{2}$$

f: a coefficient of friction resistance, which can be calculated by the following equations:

$$\frac{1}{\sqrt{f}} \approx -1.8\log_{10}\left[\frac{6.9}{\mathrm{Re}} + \left(\frac{\epsilon/D_a}{3.7}\right)^{1.11}\right] \tag{9}$$

$\epsilon/D_a$ is a relative roughness;

$$\mathrm{Re} = \frac{\rho_{mix}v_{mix}(t)D_a}{\mu} \tag{10}$$

In the above equations, μ is a viscosity of drilling liquid, $D_o$ is a wellbore diameter, $D_i$ is an outer diameter of the drilling tool within the wellbore.

The change in the hydrostatic column pressure during the drilling can be determined according to the equation (6).

The wellhead back pressure is calculated as follows:

$$P_w(t) = P_{w0} - \Delta P_h(t) + \Delta P_{safe} \tag{11}$$

$$\Delta P_h(t) = -\frac{(\rho_1 - \rho_g)V_g}{V}gH \tag{12}$$

In the equations:

$\Delta P_{safe}$ is an additional safety pressure value;

$P_{w0}$ is a wellhead back pressure when no overflow occurs.

In order to prevent occurrence of accidents, the hydraulic calculation model as shown in equations (1)-(10) can be corrected in real time by the annular pressure data collected by the PWD downhole pressure measurement-while-drilling tool, so as to greatly optimize and improve the precision of the wellbore dynamic pressure calculation model; the optimized hydraulic calculation model can be used for the real-time calculation of the dynamic hydraulic parameter for the managed pressure wellbore under various working conditions.

As described above, when checking is performed, the annular pressure lost checking and/or the wellhead back pressure checking can be used. Generally, when PWD signals can be obtained, the annular pressure lost checking can be employed; when the PWD signals cannot be obtained, the wellhead back pressure checking can be employed.

The annular pressure lost can be checked according to the following equations:

The checked annular pressure lost is:

$$P_f(t)_{new} = f'\frac{\rho_{mix}(t)H(t)v_{mix}^2(t)}{2D_a}$$

In the equation:

$$\Delta P(t) = P_b(t) - P_{pwd}(t) \tag{13}$$

$$P'_f(t) = P_f(t) - \Delta P(t) \tag{14}$$

Then a checked annular coefficient of friction resistance is:

$$f' = \frac{P'_f(t)}{P_f(t)} \cdot f \tag{15}$$

In the equations:

$P_{pwd}$(t): the bottom hole pressure value measured by the PWD pressure measurement-while-drilling tool at time t;

ΔP(t): a difference between the calculated bottom hole pressure and the PWD measured value.

$$\rho_{mix}(t) = \frac{m_g(t) + m_l(t)}{V(t)};$$

H(t) is the actual depth-chilled at time t;

$$v_{mix}(t) = \frac{Q_{mix}(t)}{A};$$

$Q_{mix}$(t) is the measured value (volume flow) by the mass flowmeter at time t; A is the annular flow area; and $D_a$ is a hydraulic diameter.

The wellhead back pressure can be checked according to the following equations:

The checked bottom hole pressure is: $P'_b(t) = \alpha P_b(t)$ (16)

The checked wellhead back pressure is: $P'_w(t) = P'_b(t) - P_h(t) - P_f(t)$ (17)

In the equations:

$$\alpha = \frac{P_{pwd}(t)}{P_b(t)} \tag{18}$$

α: is a ratio between the measured pressure value by PWD and the calculated value of the bottom hole pressure at time t; the choke valve can be controlled based on the wellhead pressure.

Figure 2:
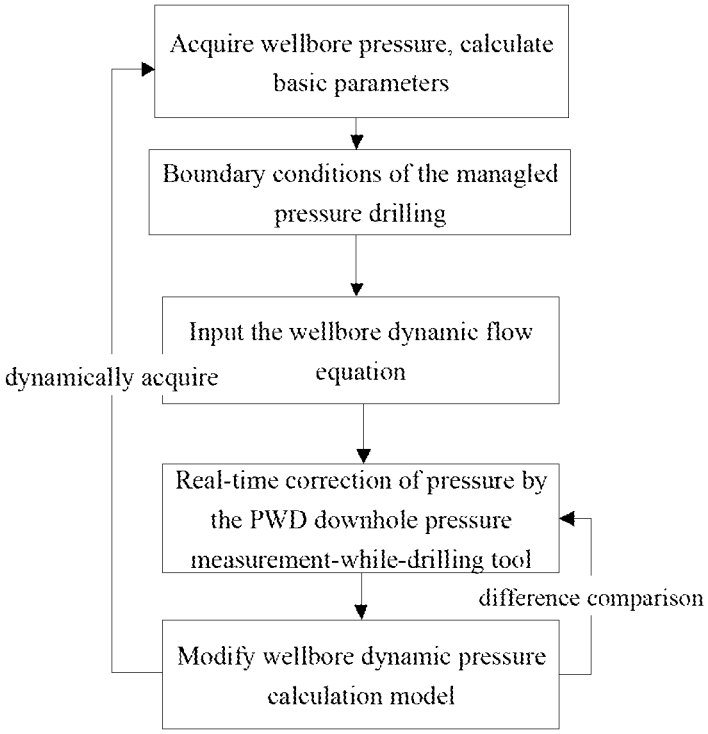
FIG. 2 is a flow diagram of the wellbore dynamic pressure correction provided in the invention.

FIG. 2 shows the wellbore dynamic pressure correction provided in an embodiment of the invention. In this embodiment, to facilitate understanding, first three steps present in the existing art are added. As shown in FIG. 2, during the correction process, basic parameters for calculation of the wellbore pressure are acquired at first, for example, including the non-real time measurement parameters such as an known wellbore structure, a make-up of string and size, a density of drilling liquid, performance and the like, and real-time measurement parameters which are dynamically acquired in real time such as bottom hole pressure, wellhead back pressure, chilling liquid flow rate, volume change of the drilling liquid circulating tank and the like. Then, boundary conditions for the MPD can be determined. For example, according to requirements for the MPD emergency technique, the boundary conditions may be that: the upper limit of the wellhead back pressure is about 5-7 MPa, the content of hydrogen sulfide is less than 20 ppm and the overflow amount is not more than 1 $m^3$. And then the bottom hole pressure and the annular pressure lost can be calculated according to the wellbore dynamic flow equation (i.e., the hydraulic calculation model). Then the annular pressure lost or wellhead pressure can be checked according to the solutions provided in embodiments of the invention, and the wellbore dynamic pressure calculation model can be modified by the checked annular pressure lost or wellhead pressure; the MPD is performed according to the model, that is, the checked annular pressure lost or wellhead pressure is used as a target value, which is used for controlling the choke valve aperture by a wellhead throttling manifold system, to adjust the wellhead back pressure, and thereby to accurately control the bottom hole pressure. The difference between the calculated bottom hole pressure and the actually measured bottom hole pressure can be used to adjust an annular checking coefficient in the hydraulic calculation model.

While some preferred embodiments of the present invention are described in detail above in conjunction with the accompanying drawings, the present invention is not limited to the specific details in those embodiments. Various simple modifications can be made to the technical solutions of the present invention within the technical conceptual scope of the present invention, and these simple modifications belong to the protection scope of the present invention.

In addition, it should be appreciated that the technical features described in the above embodiments can be combined in any appropriate manner, provided that there is no conflict among the technical features in combination. To avoid unnecessary iteration, such possible combinations are not described here in the present invention.

Moreover, different embodiments of the present invention can be combined freely as required as long as the combinations do not deviate from the spirit of the present invention. Such combinations shall also be deemed as falling into the scope disclosed in the present invention.

The invention claimed is:

1. A method for wellbore pressure correction, comprising:

measuring a bottom hole pressure using a downhole pressure measurement-while-drilling tool;

calculating a predicted bottom hole pressure; and correcting a wellbore pressure using the measured bottom hole pressure and the predicted bottom hole pressure to achieve managed pressure drilling (MPD);

wherein the predicted bottom hole pressure is calculated according to the following equation:

$$P_b(t)=P_h(t)+P_f(t)+P_w(t);$$

where $P_b(t)$ is the bottom hole pressure at time t; $P_h(t)$ is a hydrostatic column pressure at time t, $P_f(t)$ is an annular pressure lost at time t, and $P_w(t)$ is a wellhead back pressure at time t;

wherein correcting the wellbore pressure using the measured bottom hole pressure and the predicted bottom hole pressure to achieve MPD comprises checking the wellhead back pressure according to the following equation to achieve MPD:

$$P_w'(t)=P_b'(t)-P_h(t)-P_f(t);$$

Where $P_w'(t)$ is a checked wellhead back pressure at time t, $$\alpha = \frac{P_{pwd}(t)}{P_b(t)},\ P_b'(t) = \alpha P_b(t).$$

2. The method of claim 1, wherein $$P_h(t) = \rho_{mix}(t)gH(t),\ \text{where}\ \rho_{mix}(t) = \frac{m_g(t)+m_l(t)}{V(t)},$$

$m_g(t)$ is an annular gas mass for the wellbore at time t, $m_l(t)$ is an annulus liquid mass at time t, V(t) is a volume of annular at time t, g is a gravitational acceleration, and H(t) is an actual depth-drilled at time t.

3. The method of claim 2, wherein $$P_f(t) = f\frac{\rho_{mix}(t)H(t)v_{mix}^2(t)}{2D_a},\ \text{where}\ v_{mix}(t) = \frac{Q_{mix}(t)}{A},$$

$Q_{mix}(t)$ is a measured value by a mass flowmeter at time t, A is an annular flow area, $D_a$ is a hydraulic diameter, and f is a coefficient of friction resistance.

4. The method of claim 3, wherein correcting the wellbore pressure using the measured bottom hole pressure and the predicted bottom hole pressure to achieve MPD comprises checking an annular pressure lost according to the following equation to achieve MPD:

$$P_f(t)_{new} = f'\frac{\rho_{mix}(t)H(t)v_{mix}^2(t)}{2D_a}$$

Where is $$f' = \frac{P_f'(t)}{P_f(t)}\cdot f,\ P_f'(t) = P_f(t) - \Delta P(t),$$

$$\Delta P(t) = P_b(t) - P_{pwd}(t),\ P_f(t)_{new}$$

is a checked annular pressure lost at time t, and $P_{pwd}(t)$ is the measured bottom hole pressure at time t.

5. The method of claim 1, wherein $P_w(t)=P_{w0}-P_h(t)-\Delta P_{safe}$, where $\Delta P_{safe}$ is an additional safety pressure value, $P_{w0}$ is the wellhead back pressure in the absence of overflow, $$\Delta P_h(t) = -\frac{(\rho_l-\rho_g)V_g(t)}{V}gH,$$

$\rho_l$ is an annulus liquid density, $\rho_g$ is a gas density on the condition of an average pressure being $$\left[\frac{P_b - P_w}{2}, \frac{P_b + P_w}{2}\right],$$

V is a volume or annular in the presence of overflow, H is a well depth in the presence of overflow, $V_g(t)=\int_0^t q_g(t)dt$, $q_g(t)$ is an overflow velocity at time t, $P_b$ is a bottom hole pressure preset at the time of designing the MPD, $P_w$ is a pressure value in a safe range of the wellhead back pressure for the MPD.

6. The method of 1, further comprising controlling a choke valve aperture such that the annular pressure lost reaches the checked annular pressure lost or the wellhead back pressure reaches the checked wellhead back pressure.

* * * * *